US008487814B2

(12) United States Patent
Wang et al.

(10) Patent No.: US 8,487,814 B2
(45) Date of Patent: Jul. 16, 2013

(54) BROADBAND ANTENNA APPLIED TO MULTIPLE FREQUENCY BAND

(75) Inventors: Chun-Chieh Wang, Taipei (TW); Chih-Hsin Chiu, Ji-An Township, Hualien County (TW); Chih-Ming Su, Taipei (TW); Chung-Ta Yu, Keelung (TW)

(73) Assignee: Inpaq Technology Co., Ltd., Miaoli County (TW)

( * ) Notice: Subject to any disclaimer, the term of this patent is extended or adjusted under 35 U.S.C. 154(b) by 790 days.

(21) Appl. No.: 12/727,059

(22) Filed: Mar. 18, 2010

(65) Prior Publication Data

US 2011/0227805 A1 Sep. 22, 2011

(51) Int. Cl.
*H01Q 1/38* (2006.01)
*H01Q 1/48* (2006.01)

(52) U.S. Cl.
USPC ..... 343/700 MS; 343/848

(58) Field of Classification Search
USPC ..... 343/700 MS, 846, 848, 702
See application file for complete search history.

(56) References Cited

U.S. PATENT DOCUMENTS 6,864,841 B2 * 3/2005 Dai et al. ..... 343/700 MS
7,825,863 B2 * 11/2010 Martiskainen et al. ..... 343/702

* cited by examiner

*Primary Examiner* — Robert Karacsony
*Assistant Examiner* — Hasan Islam
(74) *Attorney, Agent, or Firm* — Houtteman Law LLC

(57) ABSTRACT

A broadband antenna includes a substrate, a ground plane, a radiating path, a shorting path, a first connection path, a second connection path and a coupling path. The ground plane has a shorting point, a first grounding point and a second grounding point. The radiating path has a feeding point and a first connecting point. Two ends of the shorting path are respectively electrically connected with the shorting point and the feeding point, and the shorting path has a second connecting point. Two ends of the first connection path are respectively connected with the first connecting point and the second connecting point. Two ends of the second connection path are respectively connected with the first grounding point and the feeding point. One end of the coupling path is connected to the second grounding point and another end of the coupling path is separated from the shorting path.

9 Claims, 4 Drawing Sheets

BROADBAND ANTENNA APPLIED TO MULTIPLE FREQUENCY BAND

BACKGROUND OF THE INVENTION

1. Field of the Invention

The present invention relates to a broadband antenna, and more particularly to a broadband antenna applied to multiple frequency band.

2. Description of Related Art

With the development of wireless communication technologies, wireless transmission technologies are widely used in mobile information media or personal data management tools. For example, electronic products, such as notebook computers and so on, usually need to transmit/receive data to/from other data devices. Based on wireless transmission technologies, many structures can be simplifies and many connecting wires can be avoided.

To achieve the above-mentioned wireless transmission, conventional electronic products must have antennae, and most of the electronic products have inbuilt antenna devices for wireless communication. Antennae of conventional electronic products are generally divided into two categories as planar and inverse F-shaped panel antennae and monopole antennae. With the miniaturization development of electronic products, antennae need to be smaller and smaller. However, because frequency bandwidth, gain values and radiation efficiencies of planar and inverse F-shaped panel antennae are proportional to the volume of the antennae, the planar and miniaturized design for antennae causes that their frequency bandwidth and radiation efficiencies are reduced greatly. So broadband antenna devices formed by planar and inverse F-shaped panel antennae usually have narrow frequency bands, which cannot covers the 5.2~5.8 GHz work frequency range under IEEE802.11a and the 2.4~2.5 GHz work frequency range under IEEE802.11b simultaneously. Though monopole antennae have wide frequency bands, they must have large ground portions during use, which limits limited using space of electronic products such as notebook computers.

In other words, though there have been antenna devices which can work in dual frequency bands, relationships between elements of the antenna devices must be considered when operation frequency bands of the antenna devices are adjusted, which causes that the antenna devices have complicated structures. Furthermore, with the miniaturization development of wireless electronic products, antennae must be limited in a certain volume to meet the requirements of the electronic products. Accordingly, how to design smaller, lighter and stable antennae is a problem desired to be solved in wireless technology fields.

SUMMARY OF THE INVENTION

A main object of the present invention is to provide a broadband antenna which can work in many frequency bands and adjust frequency of a resonant mode of the antenna to excite the desired frequency band.

Another object of the present invention is to provide a broadband antenna which has a planarization design and can reduce the volume and size effectively to meet the miniaturization requirement of wireless communication systems and devices.

To achieve the above-mentioned objects, the present invention provides a broadband antenna applied to multiple frequency band, including: a substrate, a ground plane, a radiating path, a shorting path, a first connection path, a second connection path and a coupling path. The ground plane is disposed on the substrate and has a shorting point, a first grounding point and a second grounding point. The radiating path is disposed on the substrate and adjacent to the ground plane, the radiating path has a feeding point disposed on one end thereof, the feeding point corresponds to the first grounding point, and the radiating path has a first connecting point formed thereon. The shorting path is disposed on the substrate, two ends of the shorting path are respectively electrically connected with the shorting point and the feeding point, and the shorting path has a second connecting point formed thereon. The first connection path is disposed on the substrate, two ends of the first connection path are respectively electrically connected with the first connecting point and the second connecting point. The second connection path is disposed on the substrate, two ends of the second connection path are respectively electrically connected with the first grounding point and the feeding point. The coupling path is disposed on the substrate, one end of the coupling path is electrically connected to the second grounding point and another end of the coupling path is separated from the shorting path by a predetermined distance.

To achieve the above-mentioned objects, the present invention provides a broadband antenna applied to multiple frequency band, including: a substrate, a ground plane, a radiating path, a shorting path, a first connection path, a second connection path and a coupling path. The ground plane is disposed on the substrate and has a shorting point, a first grounding point and a second grounding point. The radiating path is disposed on the substrate and adjacent to the ground plane, the radiating path has a feeding point disposed on one end thereof, the feeding point corresponds to the first grounding point, and the radiating path has a first connecting point formed thereon. The shorting path is disposed on the substrate, two ends of the shorting path are respectively electrically connected with the shorting point and the feeding point, and the shorting path has a second connecting point formed thereon. The first connection path is disposed on the substrate, two ends of the first connection path are respectively electrically connected with the first connecting point and the second connecting point. The second connection path is disposed on the substrate, two ends of the second connection path are respectively electrically connected with the first grounding point and the feeding point. The coupling path is disposed on the substrate, one end of the coupling path is electrically connected to the second grounding point and another end of the coupling path is separated from the radiating path by a predetermined distance.

Based on the above-mentioned structure, the broadband antenna of the present invention can be applied in multiple frequency band applications and can be integrated with system circuits to meet the integration and miniaturization requirements of electronic products.

To further understand features and technical contents of the present invention, please refer to the following detailed description and drawings related the present invention. However, the drawings are only to be used as references and explanations, not to limit the present invention.

DETAILED DESCRIPTION OF THE PREFERRED EMBODIMENTS

Figure 1:
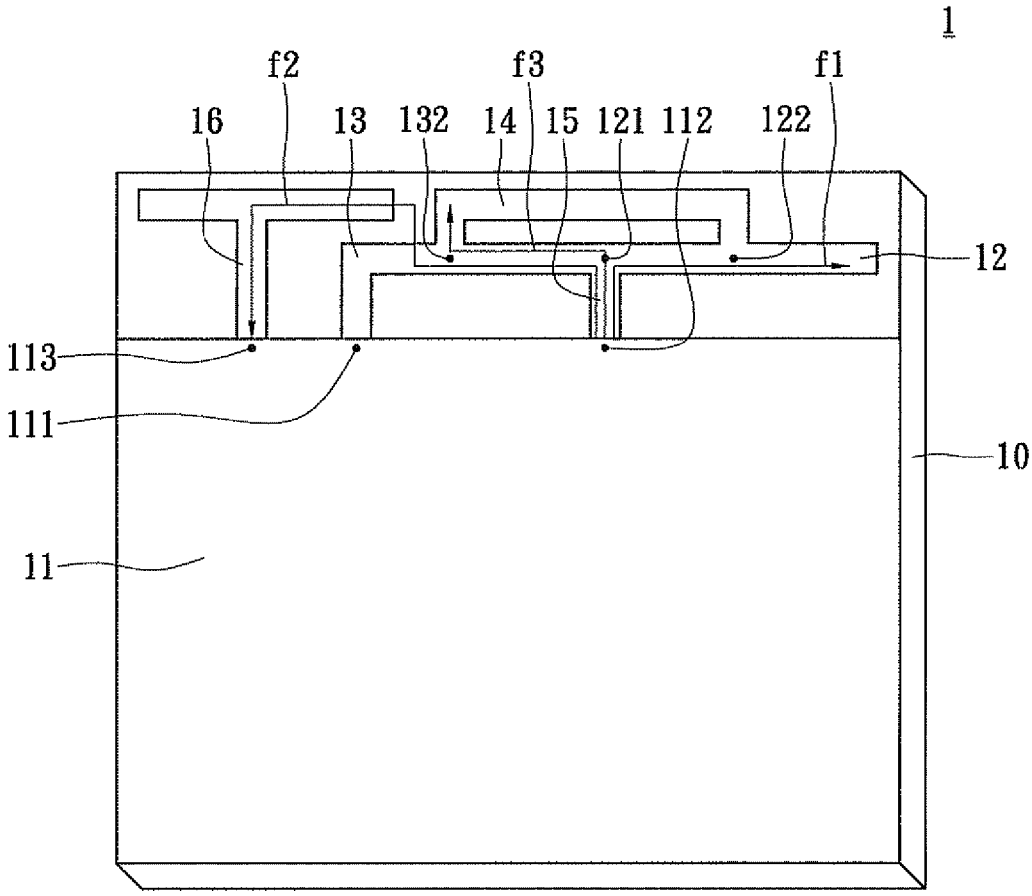
FIG. 1 is a schematic view of a broadband antenna of a first embodiment of the present invention.

Firstly, please refer to FIG. 1 illustrating a broadband antenna 1 according to the present invention which can excite resonant frequency bands based on the adjustment of the structure, the path and the width of the antenna so as to adjust desired frequency band range and electrical characteristics and can achieve multiple frequency band operation in a shorting way. The broadband antenna 1 includes a substrate 10, a ground plane 11, a radiating path 12, a shorting path 13, a first connection path 14, a second connection path 15 and a coupling path 16. The substrate 10 is used for carrying the ground plane 11, the radiating path 12, a shorting path 13 and the first connection path 14; in other words, the antenna structures, such as the ground plane 11, are all disposed on the substrate 10. The substrate 10 is a kind of solid substrate, such as a ceramic substrate, a glassfiber substrate and so on; alternatively, the substrate 10 is an air substrate.

The ground plane 11 is disposed on the substrate 10, and the ground plane 11 has a shorting point 111, a first grounding point 112 and a second grounding point 113. The radiating path 12 is disposed on the substrate 10, adjacent to the ground plane 11. A feeding point 121 is disposed on one end of the radiating path 12, corresponding to the first grounding point 112, and the radiating path 12 further has a first connecting point 122 formed thereon. The two ends of the shorting path 13 are respectively electrically connected with the shorting point 111 and the feeding point 121, and the shorting path further has a second connecting point 132 formed thereon. The two ends of the first connection path 14 are respectively electrically connected with the first connecting point 122 and the second connecting point 132.

Please refer to FIG. 1 illustrating a first embodiment of the present invention. The ground plane 11 is a metal sheet disposed on the substrate 10, the shorting point 111, the first grounding point 112 and the second grounding point 113 are located on one side of the metal sheet beside which the radiating path 12 is located, adjacent to the ground plane 11. The radiating path 12 is formed by a metal sheet without a bend, the feeding point 121 is one end point located on the metal sheet, and the first connecting point 122 may be selectively located on one position of the radiating path 12 according to actual application.

Furthermore, the shorting path 13 is formed by a metal sheet with one bend, for example, an L-shaped metal sheet. The two ends of the metallic shorting path 13 are respectively electrically connected with the shorting point 111 and the feeding point 121. In other words, the two ends of the shorting path 13 are respectively connected with the radiating path 12 and the ground plane 11. The second connecting point 132 may be selectively located on one position of the shorting path 13 according to actual application.

The first connection path 14 is formed by a metal sheet with two bends. In the embodiment, the first connection path 14 is formed by an inverse U-shaped metal sheet, and the two ends of the inverse U-shaped first connection path 14 are respectively electrically connected with the first connecting point 122 and the second connecting point 132.

The second connection path 15 is disposed on the substrate 10. Two ends of the second connection path 15 are respectively electrically connected with the first grounding point 112 and the feeding point 121. In addition, the coupling path 16 is disposed on the substrate 10. One end of the coupling path 16 is electrically connected to the second grounding point 113 and another end of the coupling path 16 is separated from the shorting path 13 by a predetermined distance. In the first embodiment, the coupling path 16 has a T-shaped body, the coupling path 16 has a bottom side connected to the second grounding point 113, and the coupling path 16 has a top side extended towards two opposite directions to form two opposite extending portions. One of the two opposite extending portions is adjacent to the shorting path 13 and the first connection path 14.

Based on the above structure, the radiating path 12, the shorting path 13 and the coupling path 16 form a resonant path for respectively generating a first operation frequency band (the low band shown as the path f1), a second operation frequency band (the middle band shown as the path f2) and a third operation frequency band (the high band shown as the path f3) of the broadband antenna 1. The first connection path 14 and the coupling path 16 are used for adjusting a frequency ratio of the first, the second and the third operation frequency bands. To adjust (1) the length (10-50 millimeters) and the width (0.5-5 millimeters) of the radiating path 12, the shorting path 13 and the coupling path 16, (2) the positions of the first connecting point 122 and the second connecting point 132, and (3) the length (1-15 millimeters) and the width (0.5-5 millimeters) of the first connection path 14 is to control the first, the second and the third operation frequency bands and the ratio (1.1-3 times) of the three frequency bands, thereby achieving multiple frequency band operation. Furthermore, the broadband antenna 1 has a good impedance match.

Figure 2:
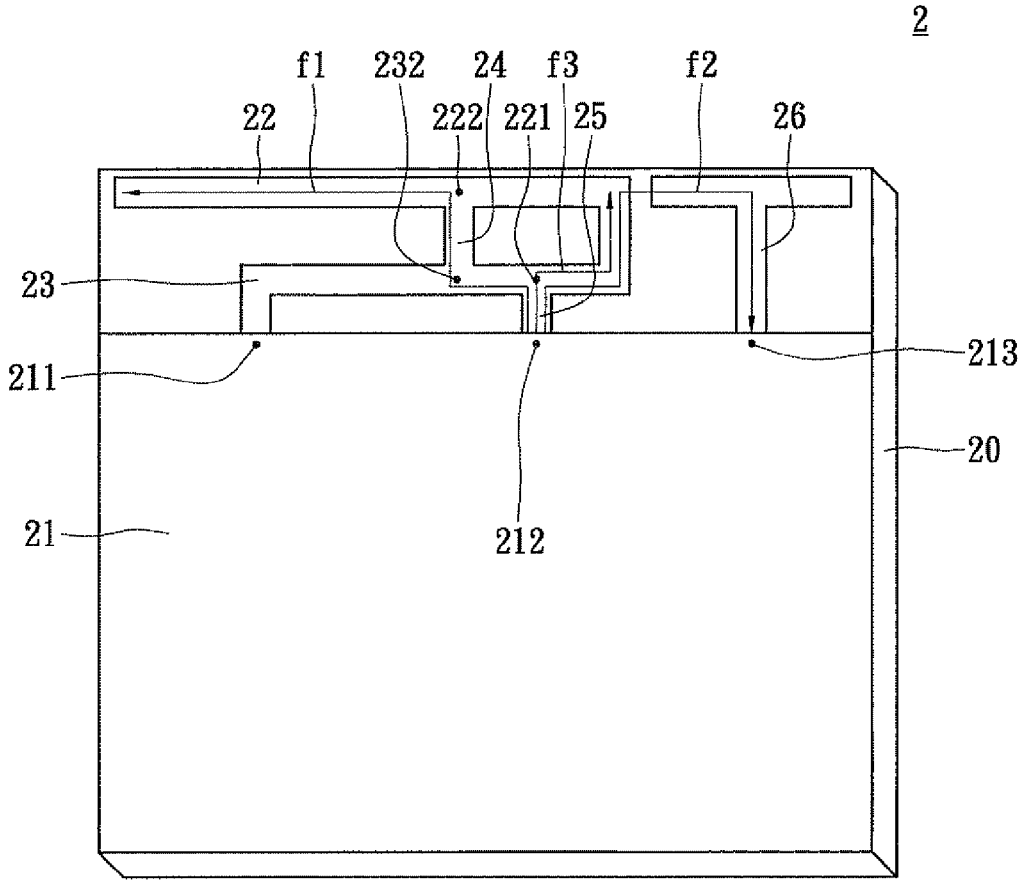
FIG. 2 is a schematic view of a broadband antenna of a second embodiment of the present invention.

Please refer to FIG. 2 illustrating a broadband antenna 2 of the second embodiment of the present invention. The ground plane 21 is a metal sheet disposed on the substrate 20, the shorting point 211, the first grounding point 212 and the second grounding point 213 are located on one side of the metal sheet beside which the radiating path 22 is located, adjacent to the ground plane 21. The radiating path 22 is formed by a metal sheet with two bends, the feeding point 221 is one end point located on the metal sheet, and the first connecting point 222 may be selectively located on one position of the radiating path 22 according to actual applications. In the embodiment, the radiating path 22 has a similar L-shaped structure, and one end of the radiating path 22 is extended parallel to one side of the ground plane 21, then bent towards the ground plane 21 and extended to form the short edge of the similar L-shaped structure. The free end of the short edge is bent and extended to form the above feeding point 221, and the first connecting point 222 is located on the long edge of the similar L-shaped structure.

Furthermore, the shorting path 23 is formed by a metal sheet with one bend, for example, an L-shaped metal sheet. The two ends of the metallic shorting path 23 are respectively electrically connected with the shorting point 211 and the feeding point 221. In other words, the two ends of the shorting path 23 are respectively connected with the radiating path 22 and the ground plane 21. The second connecting point 232 may be selectively located on one position of the shorting path 23 according to actual application.

The first connection path 24 is formed by a metal sheet without a bend. In the embodiment, the first connection path 24 is a short metal sheet, and the two ends of the first connection path 24 are respectively electrically connected with the first connecting point 222 and the second connecting point 232.

The second connection path 25 is disposed on the substrate 20. Two ends of the second connection path 25 are respectively electrically connected with the first grounding point 212 and the feeding point 221. In addition, the coupling path 26 is disposed on the substrate 20. One end of the coupling path 26 is electrically connected to the second grounding point 213 and another end of the coupling path 26 is separated from the radiating path 22 by a predetermined distance. In the second embodiment, the coupling path 26 has a T-shaped body, the coupling path 26 has a bottom side connected to the second grounding point 213, and the coupling path 26 has a top side extended towards two opposite directions to form two opposite extending portions. One of the two opposite extending portions is adjacent to the radiating path 22.

Figure 3:
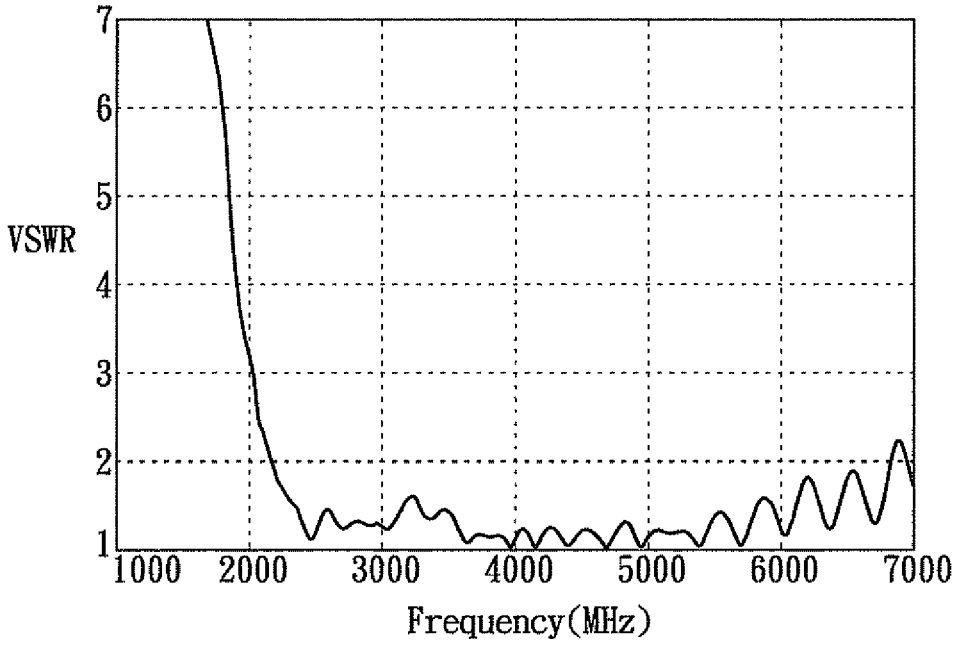
FIG. 3 is a VSWR graph of the broadband antenna of the second embodiment of the present invention applied in a wireless local area Network.
Figure 4A:
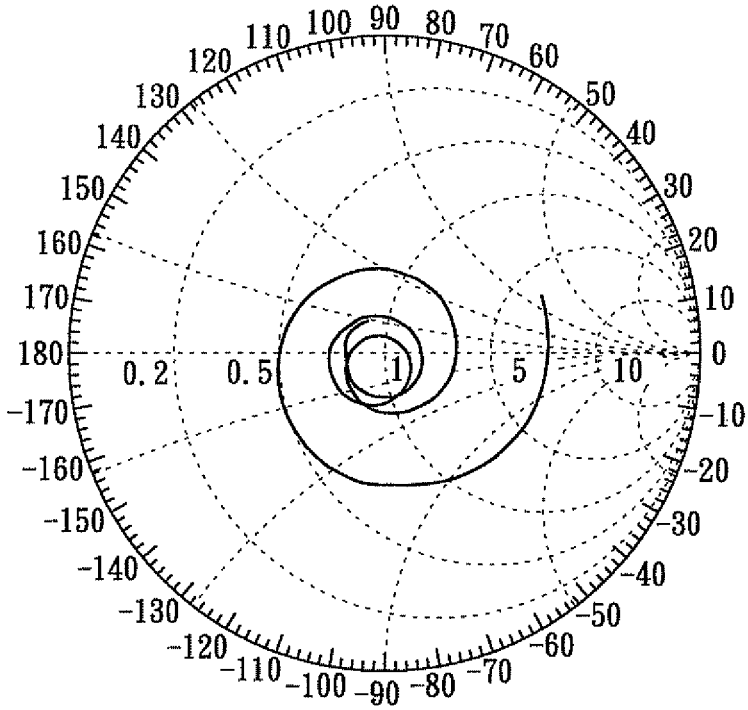
FIG. 4A is a Smith Chart of the broadband antenna of the second embodiment of the present invention operated at 2.5 GHz.
Figure 4B:
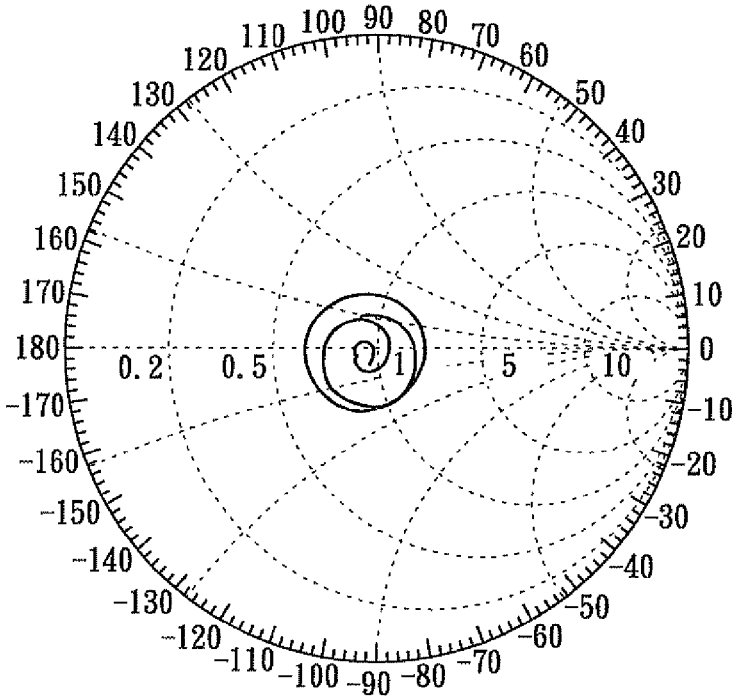
FIG. 4B is a Smith Chart of the broadband antenna of the second embodiment of the present invention operated at 3.5 GHz.
Figure 4C:
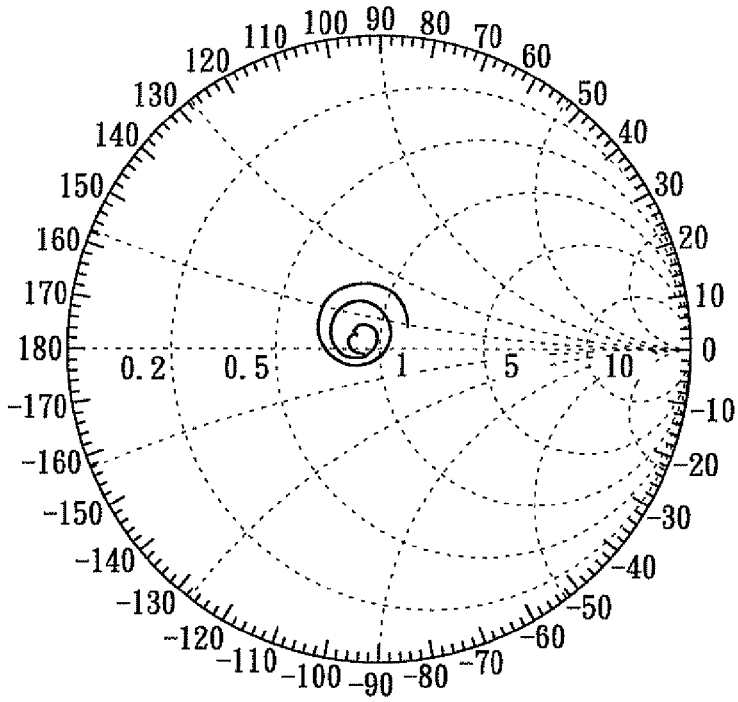
FIG. 4C is a Smith Chart of the broadband antenna of the second embodiment of the present invention operated at 5.5 GHz.

On the other hand, the second embodiment has the same sizes and width conditions with the first embodiment, so it is omitted herein. Please refer to FIG. 3 illustrating a VSWR graph of the broadband antenna 2 of the second embodiment applied in a wireless local area Network, FIG. 4A is a Smith Chart of the broadband antenna 2 of the second embodiment operated at 2.5 GHz, FIG. 4B is a Smith Chart of the broadband antenna 2 of the second embodiment operated at 3.5 GHz, and FIG. 4C is a Smith Chart of the broadband antenna 2 of the second embodiment operated at 5.5 GHz. From the results, the broadband antenna 2 of the present invention has good antenna characteristics.

What are disclosed above are only the specification and the drawings of the preferred embodiments of the present invention and it is therefore not intended that the present invention be limited to the particular embodiments disclosed. It will be understood by those skilled in the art that various equivalent changes may be made depending on the specification and the drawings of the present invention without departing from the scope of the present invention.

What is claimed is:

1. A broadband antenna applied to multiple frequency bands, comprising:

a substrate; a ground plane, disposed on the substrate and having a shorting point, a first grounding point and a second grounding point;

a radiating path disposed on the substrate and adjacent to the ground plane, the radiating path having a feeding point disposed on one end thereof, the feeding point corresponding to the first grounding point, and the radiating path having a first connecting point formed thereon;

a shorting path disposed on the substrate, two ends of the shorting path respectively electrically connected with the shorting point and the feeding point, and the shorting path having a second connecting point formed thereon;

a first connection path disposed on the substrate, two ends of the first connection path respectively electrically connected with the first connecting point and the second, connecting point;

a second connection path disposed on the substrate, two ends of the second connection path respectively electrically connected with the first grounding point and the feeding point; and a coupling path disposed on the substrate, one end of the coupling path electrically connected to the second grounding point and another end of the coupling path separated from the shorting path by a predetermined distance.

2. The broadband antenna as claimed in claim 1, wherein the ground plane is a metal sheet, and the shorting point, the first grounding point and the second grounding point are located on one side of the metal sheet beside which the radiating path is located.

3. The broadband antenna as claimed in claim 2, wherein the radiating path is a metal sheet without a bend.

4. The broadband antenna as claimed in claim 3, wherein the shorting path is a metal sheet with one bend, two ends of the shorting path are respectively electrically connected with the shorting point and the feeding point.

5. The broadband antenna as claimed in claim 4, wherein the first connection path is a metal sheet with two bends, two ends of the first connection path are respectively electrically connected with the first connecting point and the second connecting point.

6. The broadband antenna as claimed in claim 5, wherein the first connection path is an inverse U-shaped metal sheet.

7. The broadband antenna as claimed in claim 1, wherein the substrate is a solid substrate or an air substrate.

8. The broadband antenna as claimed in claim 1, wherein the coupling path has a T-shaped body, the coupling path has a bottom side connected to the second grounding point, and the coupling path has a top side extended towards two opposite directions.

9. A broadband antenna applied to many frequency bands, comprising:

a substrate;

a ground plane, disposed on the substrate and having a shorting point, a first grounding point and a second grounding point;

a radiating path disposed on the substrate and adjacent to the ground plane, the radiating path having a feeding point disposed on one end thereof, the feeding point corresponding to the first grounding point, and the radiating path having a first connecting point formed thereon;

a shorting path disposed on the substrate, two ends of the shorting path respectively electrically connected with the shorting point and the feeding point, and the shorting path having a second connecting point formed thereon;

a first connection path disposed on the substrate, two ends of the first connection path respectively electrically connected with the first connecting point and the second connecting point;

a second connection path disposed on the substrate, two ends of the second connection path respectively electrically connected with the first grounding point and the feeding point; and a coupling path disposed on the substrate, one end of the coupling path electrically connected to the second grounding point and another end of the coupling path separated from the radiating path by a predetermined distance.

* * * * *